US006484633B2

(12) United States Patent
Fina

(10) Patent No.: US 6,484,633 B2
(45) **Date of Patent: *Nov. 26, 2002**

(54) SIDE WALL FOR AN INK FOUNTAIN OF A PRINTING MACHINE

(75) Inventor: Raffaele Fina, Lausanne (CH)

(73) Assignee: De la Rue Giori S.A., Lausanne (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 164 days.

(21) Appl. No.: 09/483,815

(22) Filed: Jan. 15, 2000

(65) Prior Publication Data

US 2002/0011163 A1 Jan. 31, 2002

(30) Foreign Application Priority Data

Jan. 20, 1999 (CH) ..... 0105/99

(51) Int. Cl.[7] ..... B41F 31/02
(52) U.S. Cl. ..... 101/369; 318/259; 318/261
(58) Field of Search ..... 101/148, 204, 101/207, 208, 210, 315, 321, 326, 330, 331, 340, 344, 347, 355, 350.1, 356, 360, 363–367; 118/259, 261

(56) References Cited

U.S. PATENT DOCUMENTS 1,893,148 A 1/1933 Page
2,887,049 A * 5/1959 Mueller ..... 101/364
4,991,504 A 2/1991 Fina
5,230,286 A 7/1993 Schmitt
5,243,907 A * 9/1993 Weishew ..... 101/208

FOREIGN PATENT DOCUMENTS

DE 9001758 5/1990

OTHER PUBLICATIONS

International Search Report in SN 10599 / Switzerland.

* cited by examiner

*Primary Examiner*—Eugene Eickholt
(74) *Attorney, Agent, or Firm*—Bugnion S.A.; John Moetteli

(57) ABSTRACT

The side wall (5) for an ink fountain of a printing machine has two plates (11, 14) fixed some distance apart and an intermediate plate (13) having a front edge **(13*a*) in the shape of an arc of a circle. This intermediate plate (3) is mounted between the plates in such a way that it can be shifted and tilted. The front edge of this plate contacts the circumference of an ink fountain roller (6) via springs (18, 19) acting on the intermediate plate. The wall has a slideway (10) in which the plates (11, 14, 13) are mounted. The slideway has a reinforced region (12) on one of its sides which is proximate the ink fountain roller (6). The side wall (5)** thus more effectively seals an ink fountain against leakage.

9 Claims, 3 Drawing Sheets

SIDE WALL FOR AN INK FOUNTAIN OF A PRINTING MACHINE

BACKGROUND OF THE INVENTION

The present invention relates to a side wall of an ink fountain of a printing machine, comprising at least two plates fixed some distance apart, and an intermediate plate having a front edge in the shape of an arc of a circle mounted between said plates in such a way that it can be moved and tilted, and press means acting on said intermediate plate.

The present invention also relates to an ink fountain for a printing machine comprising at least one side wall according to the present invention. Such walls and ink fountains are known in the state of the art. For example, U.S. Pat. No. 5,230,286, the content of which is incorporated by reference, describes an ink fountain for a printing machine, the side walls of which are in contact with the ink fountain roller to form the radial seal of the ink fountain. In this state of the art, the front edge of the side walls, which has the overall shape of an arc of a circle, does not press effectively against the ink fountain roller except at the ends of the arc of the circle, while that part of the front edge which lies between these ends does not touch the roller, a slot thus formed not, however, being wide enough to allow ink to pass through it.

Nonetheless, it has been found, in use, that this type of seal was not satisfactory. This is because the inks used are often abrasive and therefore merely an imperfect seal is enough for the escaping ink to quickly destroy the seal by wearing away the front edge of the walls which form the seal. In the abovementioned case in particular, the fact that the seal is in contact with the roller only at its ends and not over its intermediate part allows ink to escape through the slot and premature wear of the seal thus occurs.

U.S. Pat. No. 4,991,504, the content of which is incorporated by reference, discloses another ink fountain system comprising partition walls allowing printing with different colors. These partition walls comprise, in particular, two metal plates and an intermediate plate with a front edge in contact with the periphery of the ink fountain roller, producing sealed contact therewith. The metal plates for their part have a plastic bead along their lower edge in order to seal against the partition wall and the bottom of the ink fountain. The drawback of this system lies in the fact that the seal between the intermediate wall and the periphery of the ink fountain roller is not perfect either and that the life of the system is thus limited because of the abrasive properties of the inks which wear away the elements of the system, particularly the intermediate plate.

SUMMARY OF THE INVENTION

The purpose of the present invention is to improve the known devices.

More specifically, the object of the present invention is to provide an ink fountain in which the sealing of the side walls is markedly improved, and to do so in a simple manner and at fairly low cost.

Another object of the present invention is to provide a system which can be retrofitted to existing machines, that is to say a system which can be mounted in ink fountains which are already in service without major modification thereto.

These objects are achieved by the features defined in the claims

The side wall according to the invention makes it possible to markedly improve the sealing of the seal and therefore to greatly lengthen its life. On account of its simplicity, the system is easy and inexpensive to produce and can be fitted to machines which are already in operation.

BRIEF DESCRIPTION OF THE DRAWINGS

The invention will be better understood from the detailed description of one embodiment thereof and from the figures which relate to it.

DETAILED DESCRIPTION OF THE PREFERRED EMBODIMENTS

Figure 1:
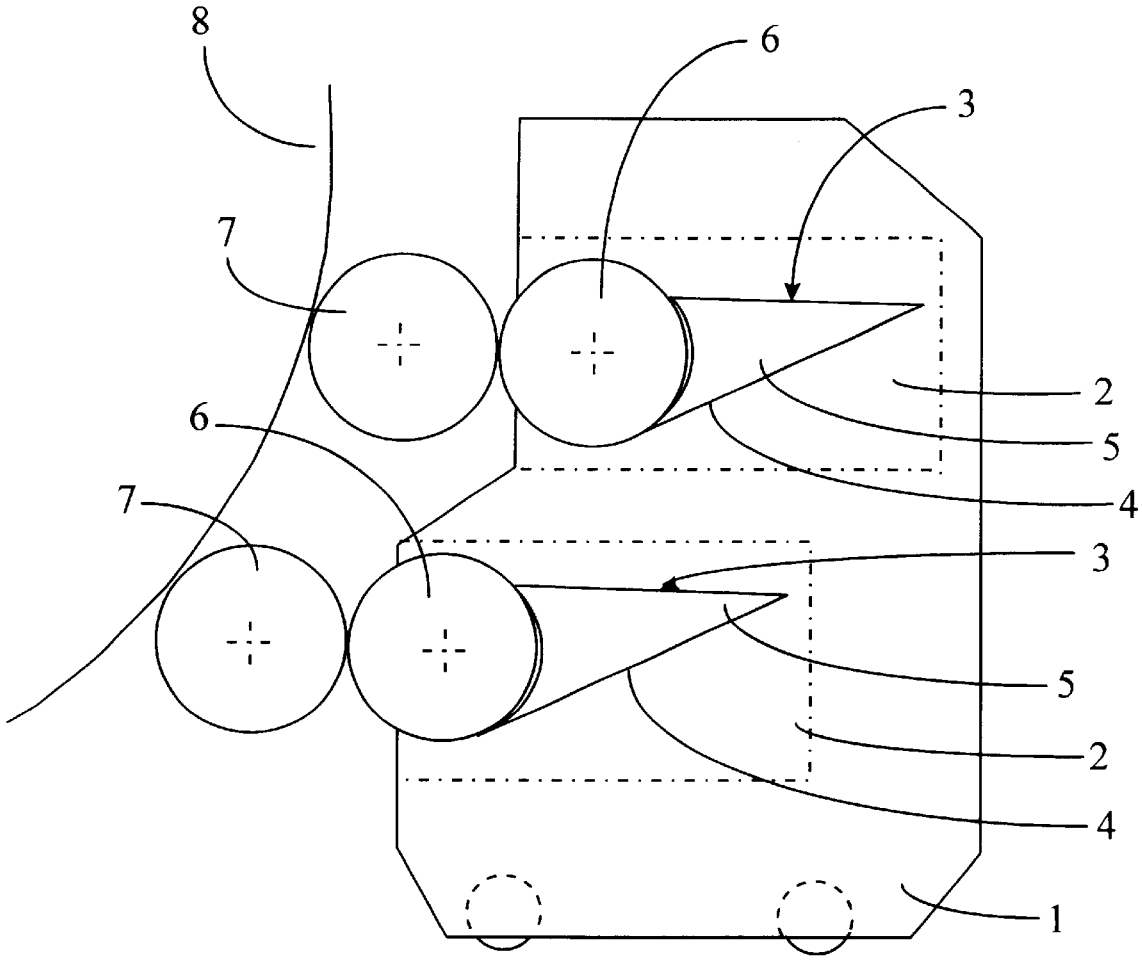
FIG. 1 diagrammatically shows an inking device comprising two ink fountains.

FIG. 1 depicts an inking device with two superposed ink fountains, of the type used in intaglio printing machines. This device is made up mainly of a mobile linking carriage 1, comprising two superposed frames 2, each frame 2 being equipped with an ink fountain 3 formed of a bottom 4 and of two side walls 5 collaborating with the ink fountain roller 6. The bottom 4 is formed of a blade, the front edge of which is close to the ink fountain roller 6. To illustrate one application of this ink fountain 3, FIG. 1 also diagrammatically depicts inking rollers 7 which, for example, ink impression plates (not depicted) mounted in a plate cylinder 8.

Figure 2:
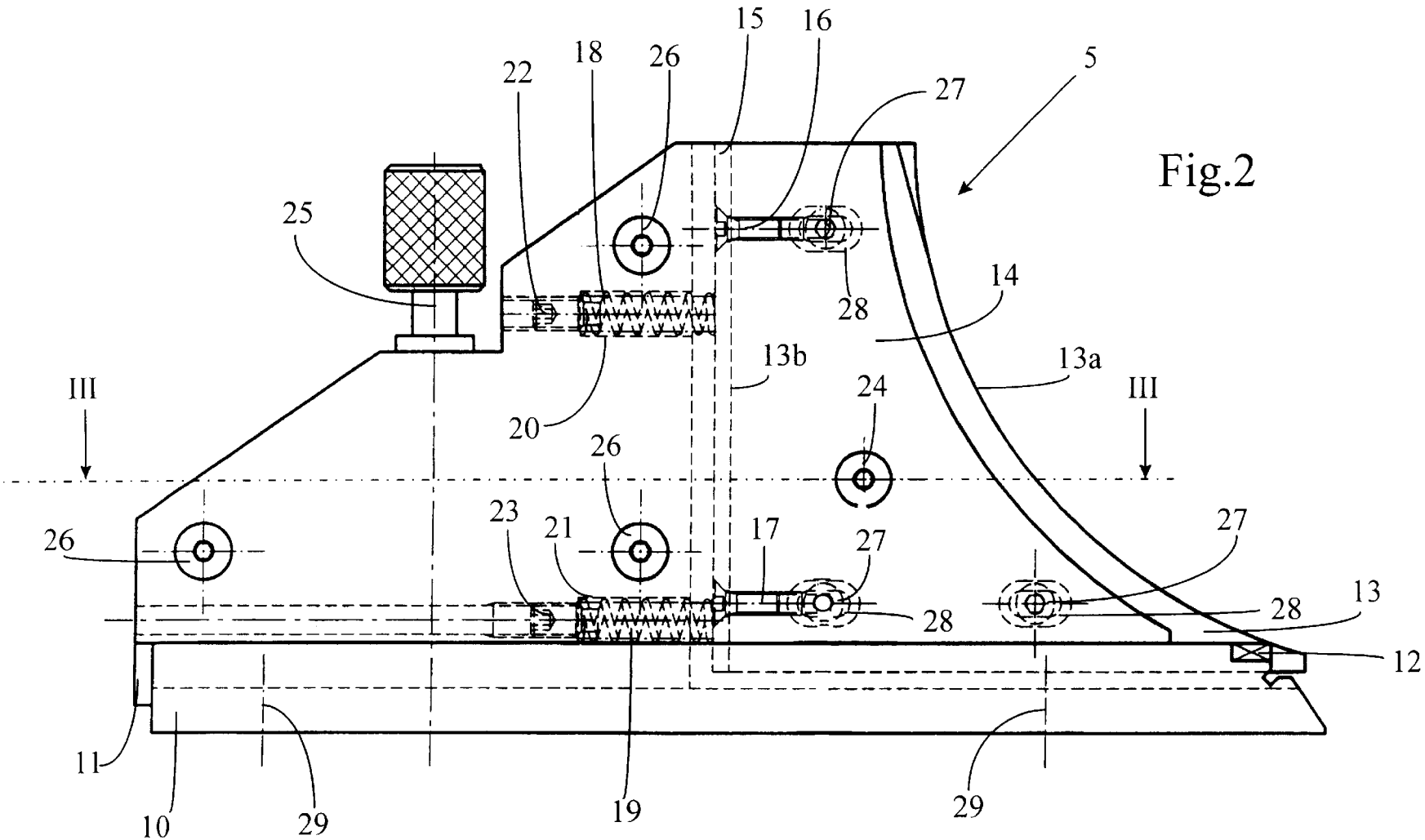
FIG. 2 shows a view in part section of a side wall of an ink fountain, from the inside of the ink fountain.

FIG. 2 is a detailed depiction of a side wall 5 seen from inside the ink fountain 3.

This side wall 5 comprises a slideway 10 which is mounted on the bottom of the ink fountain 3, for example by a screw-fastening using screws 29. The front end of the slideway 10 which is on the inside of the ink fountain 3 is in contact with the ink fountain roller 6. The slideway 10 at this point has a reinforcement 12, such as a small plate of hard material, for example metal or ceramic, which completely seals the joint between this wedge shape and the roller 6.

The side wall 5 itself comprises a first plate 11 which slides without play in said slideway 10, from the opposite end to the ink fountain roll 6. Mounted next on this first plate is an intermediate plate 13, the front edge 13*a* of which is in the shape of an arc of a circle and which plate is intended to come into contact with the circumference of the ink fountain roller 6. This intermediate plate is generally made of plastic, for example NYLATRON, and provides for the sealing of the side wall 5 along the circumference of the ink fountain roller 6.

The side wall 5 itself comprises a first plate 11 which slides without play in said slideway 10, from the opposite end to the ink fountain roller 6. Mounted next on this first plate is an intermediate plate 13, the front edge 13*a* of which is in the shape of an arc of a circle and which plate is intended to come into contact with the circumference of the ink fountain roller 6. This intermediate plate is generally made of plastic, for example Nylatron, and provides for the sealing of the side wall 5 along the circumference of the ink fountain roller 6.

This intermediate plate 13 can move longitudinally, in the direction perpendicular to the axis of rotation of the ink fountain roller 6 or in terms of rotation about an axis parallel to the axis of rotation of the ink fountain roller 6 and is kept pressed against the ink fountain roller 6 by means of the two springs 18 and 19, placed in corresponding cavities 20, 21 in the first plate 11. The axis of rotation of the intermediate plate 13 is close to or even coincident with the axis of a screw 24, depending on the longitudinal position of the intermediate plate 13. Furthermore, the two springs 18 and 19 are located one on each side of this axis of rotation of the intermediate plate 13. As a preference, the two springs 18, 19 may be preloaded by screws 22, 23. To protect the rear portion 13*b* of the intermediate plate 13 on which the two springs 18, 19 act, a small protective plate 15 is placed on said rear portion 13b, and held in place, for example using screws 16 and 17.

A second plate 14 is fixed to the first plate 11 by the screws 24, 26 and serves both to close the device and to protect the intermediate plate 13 from the ink, particularly as the latter is drying. Thus, the intermediate plate still slides correctly even if the ink has thickened or dried, and the ink fountain remains sealed.

To hold the side wall 5 in place in the slideway 10, use is made of a screw 25, the end of which may be knurled to make it easier to tighten and slacken by hand.

To ensure a perfect seal, that is to say the absence of play, between the small plate made of hard material 12 and the intermediate plate 13, it is necessary to provide a special system for adjusting the position of the intermediate plate 13 sideways with respect to the slideway 10. One 15 embodiment of this system is depicted in detail in FIG. 3 and comprises two inclined planes which collaborate in the manner of a wedge. A first inclined plane 30 is formed on the inside of the first plate 11 and a second inclined plane is formed on an intermediate part 31 which moves with respect to the first plate 11 by sliding along the first inclined plane 30, thus allowing the intermediate plate 13 to be adjusted sideways in the direction of the small plate of hard material 12 and allowing play to be eliminated. The wedge system is locked in place by the screws 27 which pass through oblong holes 28 in the intermediate part 31 and screw into the first plate 11.

The wedge system can be adjusted by hand, by adjusting the position of the intermediate plate 13 toward the piece of hard material 12, little by little, or alternatively, use may be made of a system involving a cam 32 mounted on an axle fixed to the first plate 11 and actuated by the screw 33, the cam 32 acting on the intermediate part 31 so as to move it 30 longitudinally in a direction perpendicular to the axis of the ink fountain roller 6 and thus, via the wedge system, move the intermediate plate 13 toward the piece of hard material 12.

Figure 3:
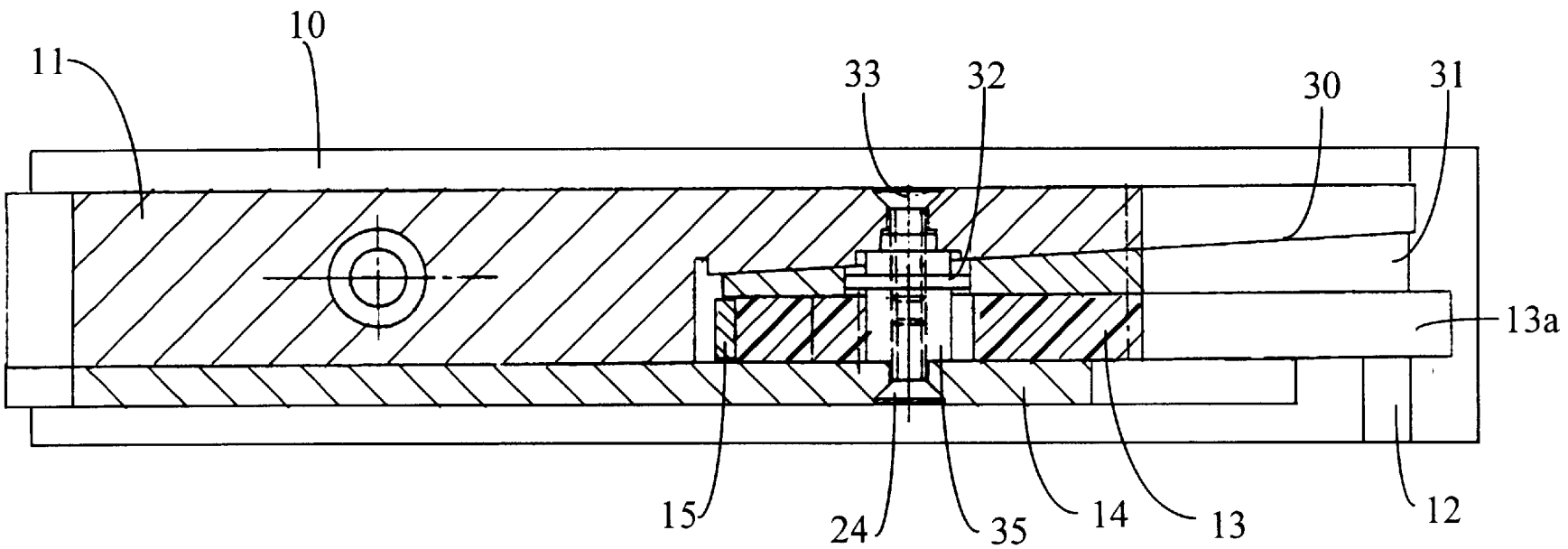
FIG. 3 shows a view from above in section on the axis III—III of the side wall of said FIG. 2.

To hold the intermediate plate 13 between the plates 11 and 14, the intermediate plate 13 is pierced with a hole through which a bushing 35 passes (see FIG. 3). This bushing 35 is itself held in position by screws 24 and 33 which pass through the plates 14 and 11 respectively.

The embodiment described is described by way of example and the side wall on the other side of the ink fountain 3 may be constructed in the same way as the one described hereinabove but as a symmetric inversion, so that the piece of hard material 12 and the plate 15 are on the inside of the ink fountain 3.

Furthermore, the invention is not restricted to the embodiment described and variations may be made within the scope of the claimed protection. For example, the intermediate plate may be adjusted sideways by other means equivalent to the wedge system described.

The materials used, particularly those of the small plate 12 and intermediate plate 13 which forms the seal may be varied.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A side wall (5) for use with an ink fountain (3) of a printing machine, the ink fountain having a blade-shaped bottom (4) and an ink fountain roller (6), said side wall having an edge adapted for contact with the ink fountain roller (6) and comprising:

two spaced-apart plates (11, 14) and an intermediate plate (13), said intermediate plate having a front edge (13*a*) in the shape of an arc of a circle adapted for contact with said ink fountain roller;

said intermediate plate of each side wall being mounted between said two spaced-apart plates (11, 14), said intermediate plate being movable and tiltable with respect to said spaced-apart plates, said front edge of said intermediate plate being biased so as to contact the outer circumferential surface of said ink fountain roller (6) when the side wall is installed against the ink fountain roller, the biasing being achieved by means of spring elements (18, 19) acting on said intermediate plate (13);

a slideway (10) in which the spaced-apart plates and said intermediate plate (11, 14, 13) are adapted for mounting on the bottom of said ink fountain; and said slideway (10) having a reinforcement member (12) adapted for contact with the circumferential surface of said ink fountain roller, said reinforcement member comprising a small plate adapted for contacting said ink fountain roller (6).

2. The side wall as claimed in claim 1, wherein said reinforcement member (12) is made of a hard material.

3. A side wall as claimed in claim 2, wherein said spaced-apart plates (11, 14) are mounted in the slideway (10) without lateral play.

4. A side wall as claimed claim 1, wherein said intermediate plate (13) is mounted between said spaced-apart plates (11, 14) on an adjustable wedge system (30, 31) thus allowing the side wall to be adjusted sideways.

5. A side wall as claimed in claim 1, wherein said spaced-apart plates (11, 14) are locked in position in said slideway (10) by a fastening means (25).

6. A side wall as claimed in claim 1, wherein said spring element (18, 19) may be preloaded.

7. A side wall as claimed in claim 1, wherein said intermediate plate (13) can be pivoted about an axis parallel to the axis of the ink fountain roller (6), said spring elements (18, 19) being mounted one each side of said axis of pivoting.

8. An ink fountain assembly for use with a printing machine, said ink fountain assembly comprising;

an ink fountain roller (6);

a blade-shaped bottom (4) having an edge contacting the ink fountain roller (6); two side walls (5) contacting said Made-shaped bottom (4) each side wall (5) comprising at least two spaced-apart plates (11, 14) and an intermediate plate (13), said intermediate plate having a front edge (13*a*) in the shape of an arc of a circle which contacts said ink fountain roller;

said intermediate plate of each side wall being mounted between said at least two spaced-apart palates, each said intermediate plate being movable and tiltable with respect to said at least two spaced-apart plates, said front edge of said intermediate plate being biased into contact with the outer circumferential surface of said ink fountain roller (6) by means of spring elements (18, 19) acting on said intermediate plate (13); and a slideway (10) in which at the spaced-apart plates and said intermediate plate (11, 14, 13) are mounted on the bottom of said ink fountain, said slideway (10) having a reinforcement member (12) contacting the circumferential surface of said ink fountain roller, each said reinforcement member comprising a small plate of hard material.

9. An ink fountain as claimed in claim 8, wherein the slideways (10) are fixed to the bottom (4) of the ink fountain (3) by means of screws (29).

* * * * *